US005858640A

United States Patent [19]

Cowdery-Corvan et al.

[11] Patent Number: 5,858,640

[45] Date of Patent: Jan. 12, 1999

[54] THERMALLY PROCESSABLE IMAGING ELEMENT COMPRISING SULFENIMIDE COMPOUNDS

[75] Inventors: Peter J. Cowdery-Corvan, Webster; Roger L. Klaus, Rochester; Franklin D. Saeva, Webster, all of N.Y.

[73] Assignee: Eastman Kodak Company, Rochester, N.Y.

[21] Appl. No.: 857,750

[22] Filed: May 16, 1997

[51] Int. Cl.[6] ..... G03C 1/498

[52] U.S. Cl. ..... 430/619; 430/600; 430/607; 430/611; 430/613; 430/615; 430/617

[58] Field of Search ..... 430/617, 619, 430/613, 611, 600, 615, 607

[56] References Cited

U.S. PATENT DOCUMENTS

| | | | |
|---|---|---|---|
| 3,839,041 | 10/1974 | Hiller . | |
| 3,957,491 | 5/1976 | Ohi et al. . | |
| 4,181,530 | 1/1980 | Ikenoue et al. . | |
| 5,439,790 | 8/1995 | Muthyala et al. . | |
| 5,441,866 | 8/1995 | Miller et al. | 430/619 |
| 5,604,088 | 2/1997 | Asami et al. | 430/611 |

FOREIGN PATENT DOCUMENTS

| | | |
|---|---|---|
| 0 289 273 | 4/1988 | European Pat. Off. . |
| 1816389 | 7/1970 | Germany . |
| 215 411 | 11/1984 | Germany . |
| 63-163337 | 7/1988 | Japan . |
| 4-157457 | 5/1992 | Japan . |
| 4-186346 | 7/1992 | Japan . |
| 4-194922 | 7/1992 | Japan . |
| 4-350845 | 12/1992 | Japan . |

OTHER PUBLICATIONS

Shibuya et al., Shashin Gakkaishi (1992), 55 (4), 248–53.

*Primary Examiner*—Thorl Chea
*Attorney, Agent, or Firm*—Sarah Meeks Roberts

[57] ABSTRACT

This invention provides a thermally processable imaging element comprising a support and a thermographic or photothermographic imaging layer, said imaging layer comprising a sulfenimide compound represented by the formula:

wherein M represents the atoms necessary to form, with $R^1$ and $R^2$, a five or six-membered ring or a multiple ring system; w is 1 or 0, wherein when w is 0, $R^1$ and $R^2$ are independently substituted or unsubstituted aliphatic, aromatic or heterocyclic groups, and when w is 1, $R^1$ and $R^2$ are independently carbonyl or sulfonyl groups; $R^3$ is independently a substituted or unsubstituted aliphatic, aromatic or heterocyclic group and x is 0 or 1.

In one embodiment the thermally processable imaging element comprises:

(a) photographic silver halide, and (b) an image-forming combination comprising (i) an organic silver salt oxidizing agent, with (ii) a reducing agent for the organic silver salt oxidizing agent.

16 Claims, No Drawings

THERMALLY PROCESSABLE IMAGING ELEMENT COMPRISING SULFENIMIDE COMPOUNDS

FIELD OF THE INVENTION

This invention relates in general to imaging elements and in particular to thermally processable imaging elements. More specifically, this invention relates to imaging elements which comprise a thermographic layer or photothermographic layer and which contain sulfenimide compounds as antifoggants.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure,* June 1978, Item No. 17029 and U.S. Pat. Nos. 3,080,254, 3,457,075 and 3,933,508.

One common photothermographic element comprises an oxidation-reduction image forming composition containing an organic silver salt oxidizing agent, a photocatalyst such as silver halide, and a reducing agent. The element is stable at ambient temperature, however, after exposure to light, the organic silver salt oxidizing agent and the reducing agent, when heated, undergo an oxidation-reduction reaction due to the catalytic action of the photocatalyst and form silver. The silver formed darkens the exposed areas of the photosensitive layer and creates an image.

A problem which frequently occurs with these types of elements is unintentional darkening of the unexposed areas of the photosensitive layer. This may be caused by reducing agent impurities in the coated element. This darkening is often referred to as fog. One compound which has been commonly used to suppress fog is mercuric ion. However it is known that mercury is detrimental to the environment.

Sulfenimide compounds containing an inhibitor fragment which is released during a conventional wet development process have been described in JP 04-194922, JP 04-186346, JP 04-157457, JP 04-350845, JP 63-163337 and DD 251 411. Phthalimide and various substituted phthalimides have been used widely as image tone modifiers and/or development accelerators in photothermographic or thermographic elements, for example, see U.S. Pat. No. 3,839,041. Phthalimides when substituted with electronegative groups, such as in 4-bromophthalimide or 4-cyanophthalimide, and incorporated into a photothermographic or thermographic film, have been described as reducing heat fog in U.S. Pat. No. 4,181,530. Certain N-substituted phthalimides (where N is a halogen atom) have been described as fog inhibitors in photothermographic films, U.S. Pat. No. 3,957,491. Finally, U.S. Pat. No. 5,439,790 describes the use of phthalimide blocked compounds of the general structure below for releasing a post processing stabilizer in a photothermographic film, where the A moiety can be, for example, a triazine or tetrazole group.

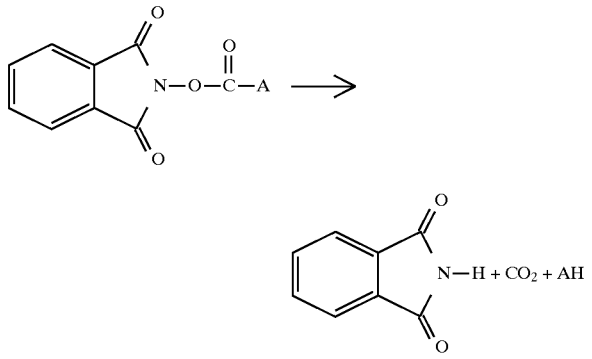

There is still, however, a continuing need in the industry for practical and environmentally benign stabilizers and fog preventers which do not otherwise adversely affect the performance of the thermographic element. The inventors herein have discovered that certain sulfenimide compounds are particularly useful as fog restrainers for such elements.

SUMMARY OF THE INVENTION

This invention provides a thermally processable imaging element comprising a support and a thermographic or photothermographic imaging layer, said imaging layer comprising a sulfenimide compound represented by the formula:

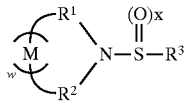

wherein M represents the atoms necessary to form, with $R^1$ and $R^2$, a five or six-membered ring or a multiple ring system; w is 1 or 0, wherein when w is 0, $R^1$ and $R^2$ are independently substituted or unsubstituted aliphatic, aromatic or heterocyclic groups, and when w is 1, $R^1$ and $R^2$ are independently carbonyl or sulfonyl groups; $R^3$ is independently a substituted or unsubstituted aliphatic, aromatic or heterocyclic group and x is 0 or 1.

In one embodiment the thermally processable imaging element comprises:

(a) photographic silver halide, and (b) an image-forming combination comprising (i) an organic silver salt oxidizing agent, with (ii) a reducing agent for the organic silver salt oxidizing agent.

The thermally processable elements of this invention exhibit less fog without a large loss of photographic speed. The sulfenimide compounds used in this invention can be used to replace mercuric salts and are themselves environmentally benign.

DETAILED DESCRIPTION OF THE INVENTION

The inventors herein have discovered that certain sulfenimide compounds are particularly useful as fog restrainers for silver halide elements. The inventive compounds herein do not utilize inhibitor fragments which are released during development by reaction with oxidized developer. The sulfenimide compounds utilized in this invention are represented by the following formula:

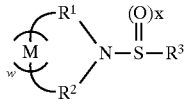

M represents the atoms necessary to form, with $R^1$ and $R^2$, a five or six-membered ring or a multiple ring system. These ring systems may be substituted or unsubstituted. The ring and multiple ring systems may be alicyclic or they may be the aromatic and heterocyclic groups described below. w is 1 or 0.

When w is 0, $R^1$ and $R^2$ can be any substituents which are suitable for use in a thermally processable imaging element and which do not interfere with the fog restraining activity of the sulfenimide compound. Preferably $R^1$ and $R^2$ are independently substituted or unsubstituted aliphatic, aromatic or heterocyclic groups.

When w is 1, $R^1$ and $R^2$ are independently carbonyl or sulfonyl groups, and more preferably carbonyl groups. Preferably M represents the atoms necessary to form, with $R^1$ and $R^2$, a substituted or unsubstituted aryl group having 6 to 10 carbon atoms or a substituted or unsubstituted 5 to 10-membered heterocyclic ring. Most preferably M represents the atoms necessary to form, with $R^1$ and $R^2$, a phthalimide or succinimide group.

$R^3$ is any substituent which is suitable for use in a thermally processable imaging element and which does not interfere with the fog restraining activity of the sulfenimide compound. Preferably $R^3$ is independently a substituted or unsubstituted aliphatic, aromatic or heterocyclic group. x is 0 or 1.

When $R^1$, $R^2$ and $R^3$ are aliphatic groups, preferably, they are alkyl groups having from 1 to 20 carbon atoms. More preferably, they are alkyl groups having 1 to 6 carbon atoms. These groups may or may not have substituents. Examples of alkyl groups include methyl, ethyl, propyl, butyl, pentyl, hexyl, octyl, 2-ethylhexyl, decyl, dodecyl, hexadecyl, octadecyl, cyclohexyl, isopropyl and t-butyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings or condensed rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

In one embodiment $R^3$ is an ortho, meta or para substituted or unsubstituted alkyl group having 1 to 6 carbon atoms, a substituted or unsubstituted aryl group having 6 to 10 carbon atoms or a substituted or unsubstituted 5 to 6-membered heterocyclic ring. In one preferred embodiment, when w is 0, $R^1$ and $R^2$ are also independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

Nonlimiting examples of substituent groups for $R^1$, $R^2$ and $R^3$ and M include alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl). Preferred substituents are lower alkyl groups, i.e., those having 1 to 4 carbon atoms (for example, methyl) and halogen groups (for example, chloro).

Specific examples of the sulfenimide compounds include, but are not limited to

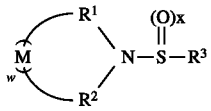

General Structure

General Structure

| $R^1$ | $R^2$ | M | W | $R^3$ | x | Compound |
|---|---|---|---|---|---|---|
| 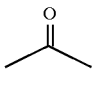 | 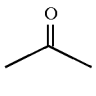 | 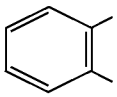 | 1 | 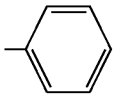 | 0 | 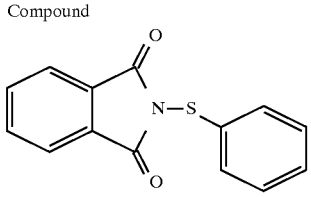 1 |
| 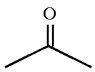 | 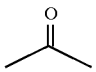 | 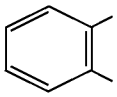 | 1 | 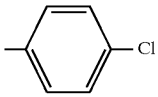 | 0 | 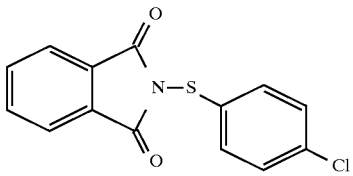 2 |

-continued
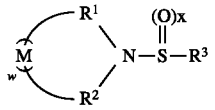
General Structure
General Structure
| $R^1$ | $R^2$ | M | W | $R^3$ | x | Compound | |
|---|---|---|---|---|---|---|---|
| 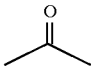 | 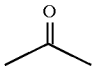 | 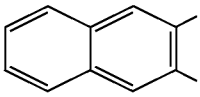 | 1 | 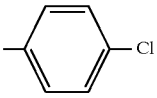 | 0 | 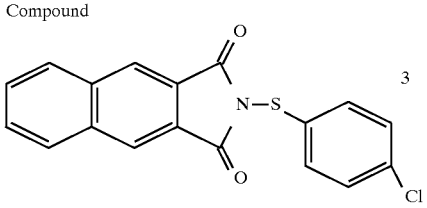 | 3 |
| 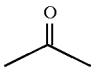 | 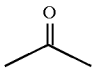 | 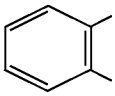 | 1 | 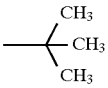 | 0 | 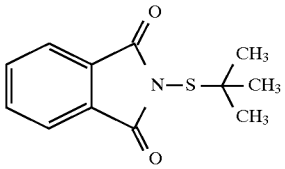 | 4 |
| 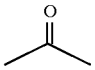 | 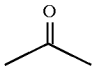 | 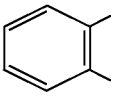 | 1 | 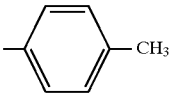 | 0 | 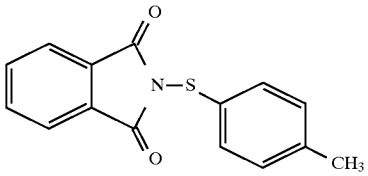 | 5 |
| 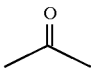 | 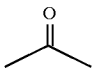 | 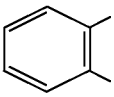 | 1 | 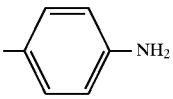 | 0 | 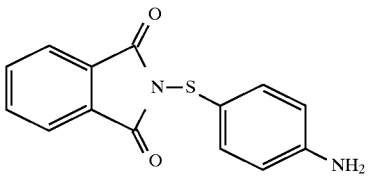 | 6 |
| 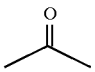 | 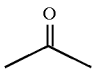 | 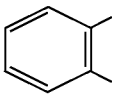 | 1 | 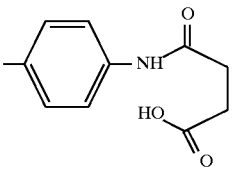 | 0 | 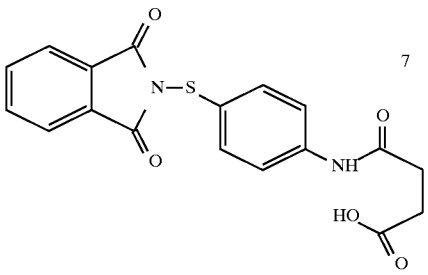 | 7 |
| 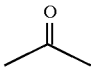 | 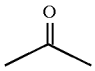 | 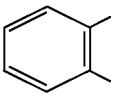 | 1 | 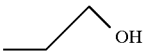 | 0 | 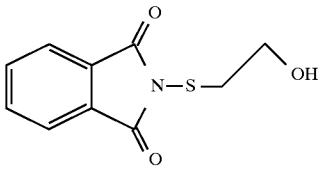 | 8 |
| 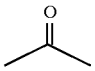 | 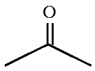 | 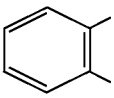 | 1 | 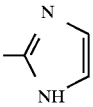 | 0 | 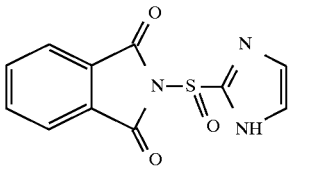 | 9 |

-continued
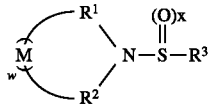
General Structure
General Structure
| $R^1$ | $R^2$ | M | W | $R^3$ | x | Compound | |
|---|---|---|---|---|---|---|---|
| 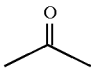 | 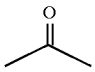 | 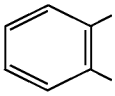 | 1 | 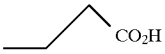 | 0 | 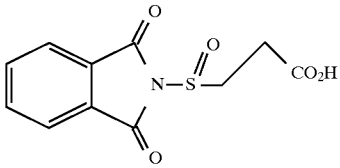 | 10 |
| 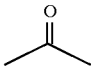 | 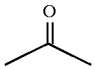 | 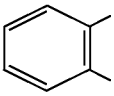 | 1 | 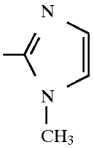 | 0 | 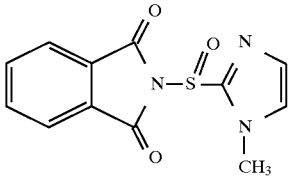 | 11 |
| 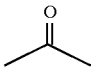 | 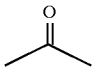 | 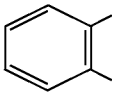 | 1 | 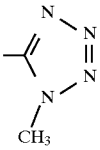 | 0 | 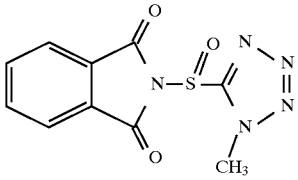 | 12 |
| 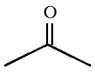 | 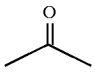 | 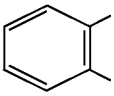 | 1 | 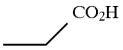 | 1 | 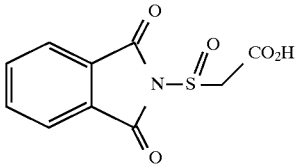 | 13 |
| 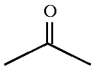 | 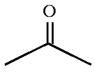 | 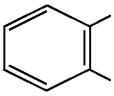 | 1 | 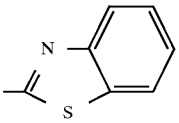 | 1 | 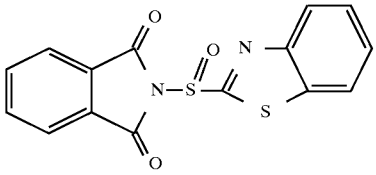 | 14 |
| 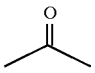 | 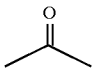 | 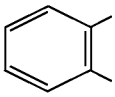 | 1 | 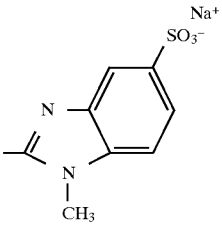 | 1 | 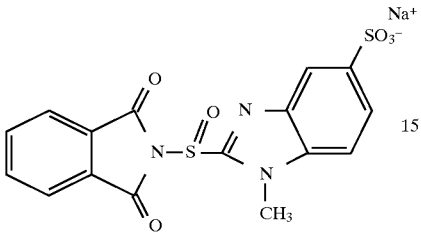 | 15 |
| 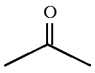 | 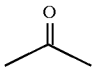 | 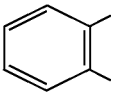 | 1 | 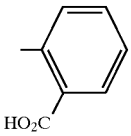 | 1 | 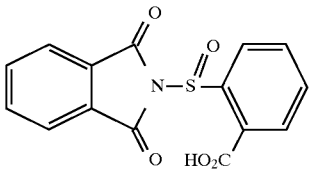 | 16 |

-continued
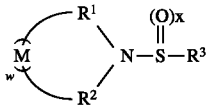
General Structure
General Structure
| $R^1$ | $R^2$ | M | W | $R^3$ | x | Compound | |
|---|---|---|---|---|---|---|---|
| 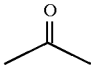 | 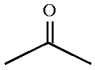 | 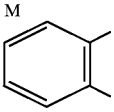 | 1 | 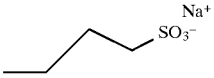 | 1 | 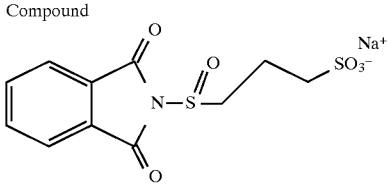 | 17 |
| 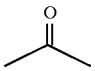 | 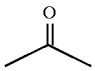 | 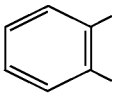 | 1 | 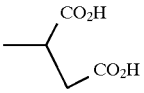 | 0 | 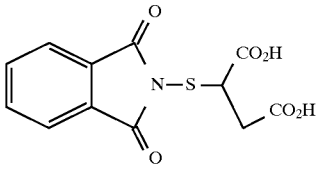 | 18 |
| 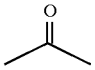 | 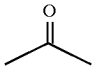 | 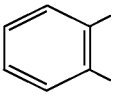 | 1 | 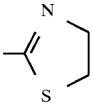 | 1 | 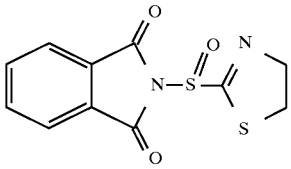 | 19 |
| 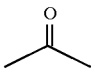 | 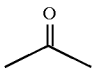 | 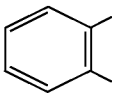 | 1 | 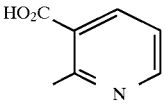 | 1 | 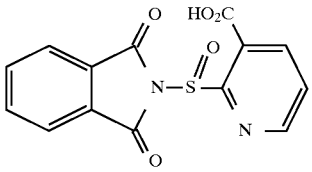 | 20 |
| 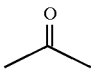 | 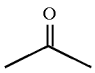 | 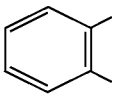 | 1 | 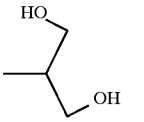 | 0 | 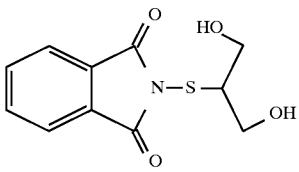 | 21 |
| 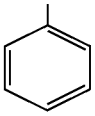 | 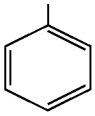 | | 0 | 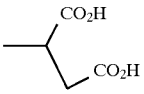 | 0 | 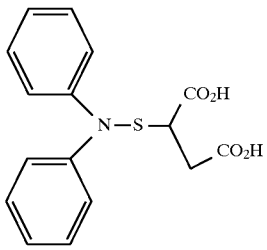 | 22 |
| 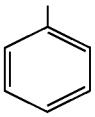 | 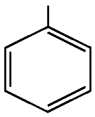 | | 0 | 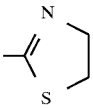 | 1 | 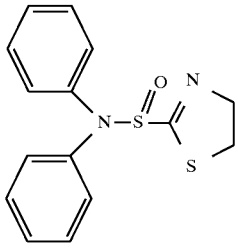 | 23 |

-continued
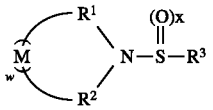
General Structure
General Structure
| $R^1$ | $R^2$ | M | W | $R^3$ | x | Compound | |
|---|---|---|---|---|---|---|---|
| 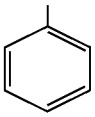 | 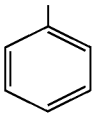 | | 0 | 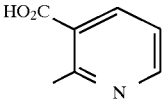 | 1 | 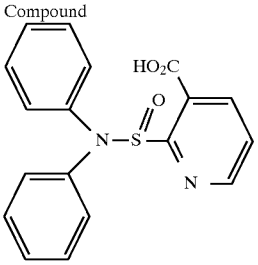 | 24 |
| 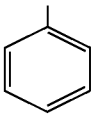 | $CH_3$ | — | 0 | 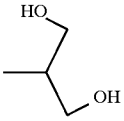 | 1 | 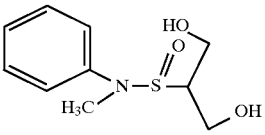 | 25 |
| 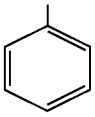 | $CH_3$ | — | 0 | 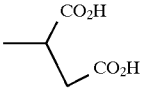 | 1 | 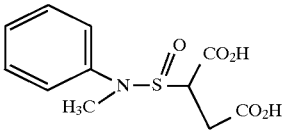 | 26 |
| 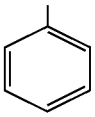 | $CH_3$ | — | 0 | 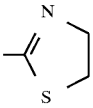 | 1 | 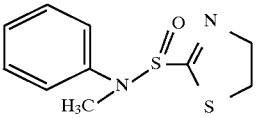 | 27 |
| 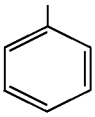 | $CH_3$ | — | 0 | 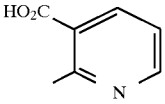 | 1 | 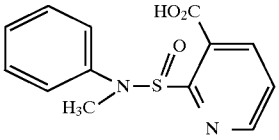 | 28 |
| — | — | $CH_2$ | 4 | 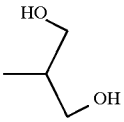 | 0 | 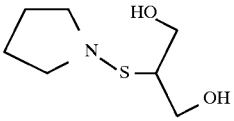 | 29 |
| — | — | $CH_2$ | 4 | 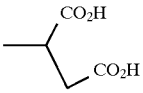 | 0 | 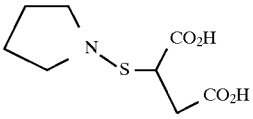 | 30 |
| — | — | $CH_2$ | 4 | 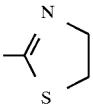 | 1 | 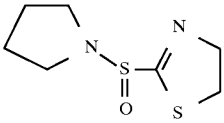 | 31 |
| — | — | $CH_2$ | 4 | 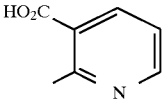 | 1 | 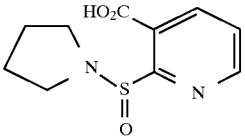 | 32 |

-continued
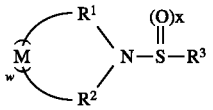
General Structure
General Structure
| $R^1$ | $R^2$ | M | W | $R^3$ | x | Compound | |
|---|---|---|---|---|---|---|---|
| 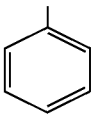 | $CH_3$ | — | 0 | 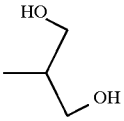 | 0 | 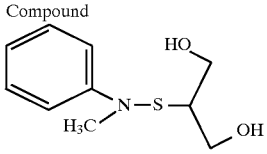 | 33 |
| 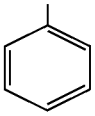 | $CH_3$ | — | 0 | 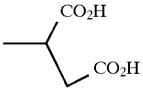 | 0 | 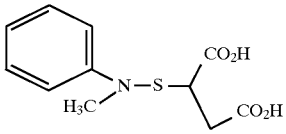 | 34 |
| 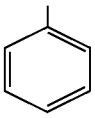 | $CH_3$ | — | 0 | 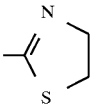 | 1 | 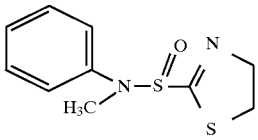 | 35 |
| 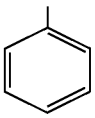 | $CH_3$ | — | 0 | 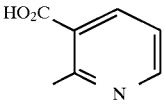 | 1 | 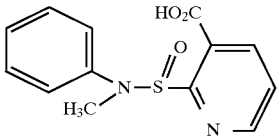 | 36 |
| $SO_2$ | $SO_2$ | 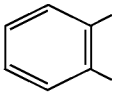 | 1 | 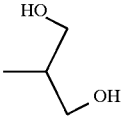 | 0 | 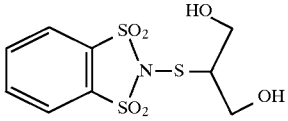 | 37 |
| $SO_2$ | 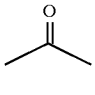 | 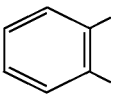 | 1 | 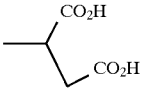 | 0 | 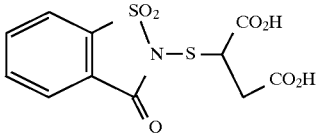 | 38 |
| $SO_2$ | 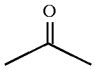 | 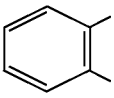 | 1 | 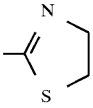 | 1 | 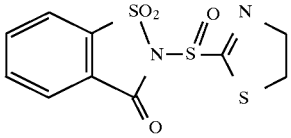 | 39 |
| $SO_2$ | 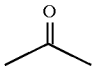 | 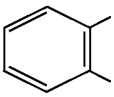 | 1 | 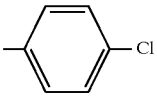 | 1 | 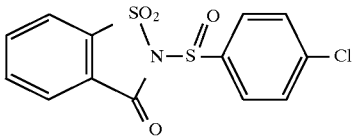 | 40 |
| 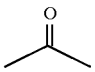 | 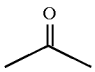 | 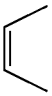 | 1 | 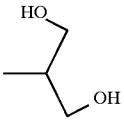 | 0 | 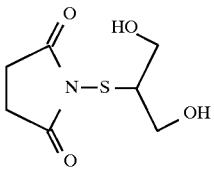 | 41 |

-continued
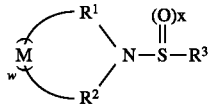
General Structure
General Structure
| $R^1$ | $R^2$ | M | W | $R^3$ | x | Compound | |
|---|---|---|---|---|---|---|---|
| 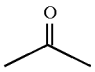 | 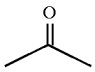 | 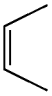 | 1 | 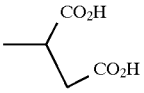 | 0 | 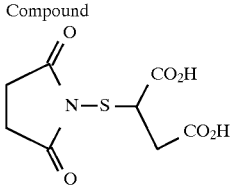 | 42 |
| 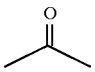 | 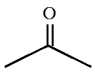 | 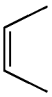 | 1 | 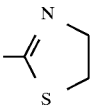 | 1 | 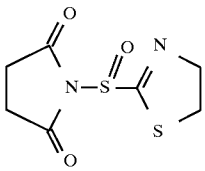 | 43 |
| 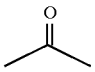 | 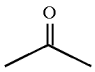 | 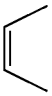 | 1 | 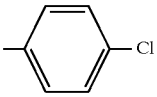 | 1 | 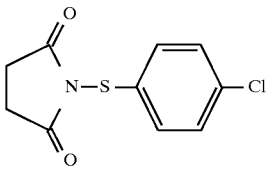 | 44 |
| $SO_2$ | 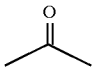 | 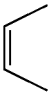 | 1 | 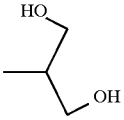 | 1 | 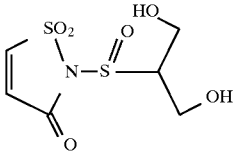 | 45 |
| $SO_2$ | 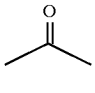 | 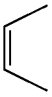 | 1 | 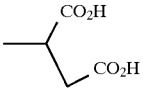 | 1 | 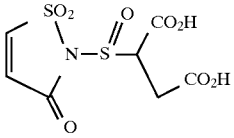 | 46 |
| $SO_2$ | 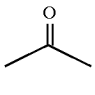 | 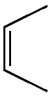 | 1 | 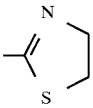 | 1 | 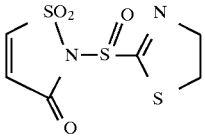 | 47 |
| $SO_2$ | 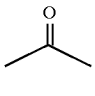 | 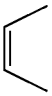 | 1 | 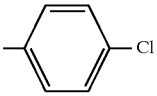 | 0 | 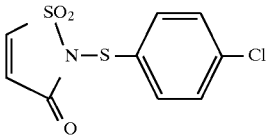 | 48 |
| 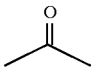 | 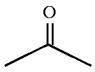 | 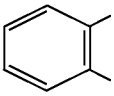 | 1 | 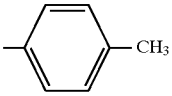 | 1 | 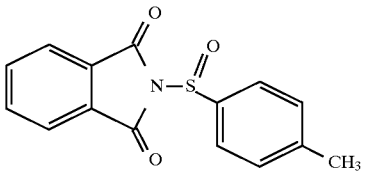 | 49 |

-continued

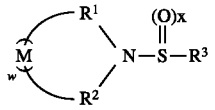

General Structure

General Structure

| $R^1$ | $R^2$ | M | W | $R^3$ | x | Compound | |
|---|---|---|---|---|---|---|---|
| 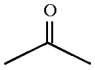 | 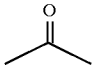 | 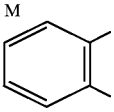 | 1 | 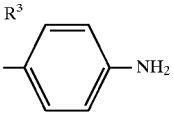 | 1 | 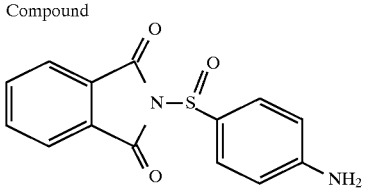 | 50 |
| 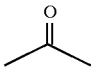 | 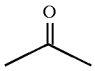 | 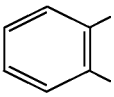 | 1 | 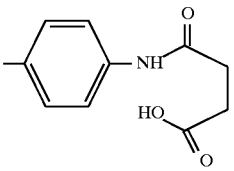 | 1 | 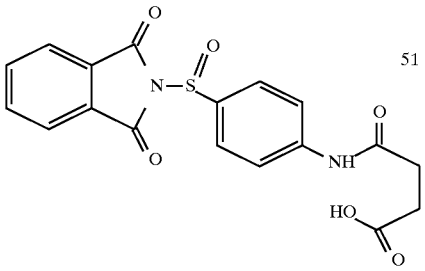 | 51 |
| 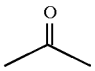 | 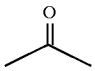 | 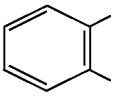 | 1 | 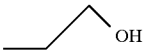 | 1 | 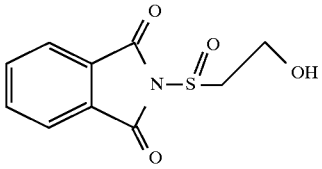 | 52 |
| 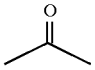 | 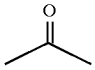 | 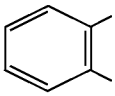 | 1 | 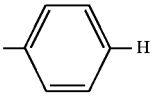 | 1 | 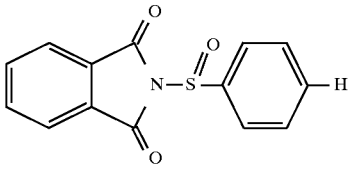 | 53 |

Compounds 1 and 2 are examples of particularly suitable compounds for use in this invention.

The sulfenimide compounds are readily synthesized by the reaction of sulfenyl chlorides with the corresponding phthalimide anion. In one embodiment, the sulfenyl chlorides may be synthesized by the reaction of excess chlorine gas with a thiol, such as thiophenol, in carbon tetrachloride solvent. The reaction should be monitored, for example by infrared spectroscopy, to determine that the reaction is complete. The carbon tetrachloride solvent is flash evaporated and the sulfenyl chloride is dissolved in a suitable solvent such as chloroform. The appropriate phthalimide, such as potassium phthalimide (commercially available from Aldrich Chemical Co.) is added to the sulfenyl chloride (one equivalent of phthalimide) at room temperature. The reaction is allowed to stir at room temperature for four hours and the extent of the reaction is determined, for example, by thin layer chromatography. The reactions are normally complete after a few hours. The chloroform solvent is flash evaporated and the sulfenimide product is recrystallized from ethanol.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention Nonlimiting examples of suitable substituents are alkyl groups (for example, methyl, ethyl, hexyl), aryl groups (for example, phenyl, naphthyl, tolyl), acyl groups (for example,. acetyl, propionyl, butyryl, valeryl), sulfonyl groups (for example, methylsulfonyl, phenylsulfonyl), alkoxy groups, hydroxy groups, alkylthio groups, arylthio groups, acylamino groups, sulfonylamino groups, acyloxy groups, carboxyl groups, cyano groups, sulfo groups and amino groups.

Useful levels of the sulfenimide compounds range from about 0.001 to 0.5000 mole and preferably from 0.001 to 0.05 mole based on one mole of silver salt oxidizing agent. The sulfenimide compounds may be added in any fashion which does not interfere with antifogging action of the compounds. The sulfenimide antifoggant is most effective when added to the silver salt oxidizing agent or it may conveniently added as a doctor solution at any point in the melt preparation prior to the addition of developer.

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, with (ii) a reducing agent for the organic silver salt oxidizing agent and (c) an optional toning agent. References describing such imaging elements include, for example, U.S. Pat. Nos. 3,457,075; 4,459,350; 4,264,725 and 4,741,992 and *Research Disclosure,* June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above *Research Disclosure* publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate, with silver behenate being particularly useful. Combinations of organic silver salt oxidizing agents are also useful. An example of a useful organic silver salt oxidizing agent that is not an organic silver salt of a fatty acid is silver benzotriazole.

The optimum concentration of organic silver salt oxidizing agent in the photothermographic element will vary depending upon the desired image, particular organic silver salt oxidizing agent, particular reducing agent and particular photothermographic element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1 -phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene- sulfonamidophenol; 4-benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The thermally processable element can comprise a variety of supports. Examples of useful supports are poly (vinylacetal) film, polystyrene film, poly(ethylene terephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure,* June 1978, Item No. 17029 and *Research Disclosure,* December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-(p-tolysulfonyl)acetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, resistive head heater, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

The following non-limiting examples will further illustrate this invention.

EXAMPLE

A control photothermographic element was prepared having the following composition:

| | mg/ft$^2$ |
|---|---|
| OVERCOAT | |
| Polyvinylalcohol (Elvanol 52/22, E. I. DuPont de Nemours Co., Inc.) | 68.0 |
| Poly(silicic acid), (PSA, see US 4,741,992) | 107.4 |
| Matte | 7.1 |
| Surfactant (10G from Olin Corp., USA) | 2.9 |
| Blue dye (Victoria Pure Blue BO, Aldrich Chemical Co., Inc.) | 1.3 |
| PHOTOTHERMOGRAPHIC LAYER | |
| Silver Behenate (Ag) | 107.0 |
| AgBr (Ag) | 22.0 |
| NaI | 4.9 |
| $SnCl_2$ Foggant | (see Table I) |
| Succinimide toner/development accelerator | 23.1 |
| Surfactant (SF-96 is a polysiloxane fluid available from and a trademark of General electric Co., U.S.A.) | 0.4 |
| Stabilizer, 2-Bromo-2-(p-tolylsulfonyl)acetamide | 6.3 |
| Photobleach, 2,4-Bis(trichloromethyl)-6-(1-naphtho)-s-triazine | 1.5 |
| Palmitic acid | 10.0 |
| Antifoggant | (see Table I) |
| Poly(vinylbutyral)binder, (Butvar-76, a trademark of the Monsanto Co., U.S.A.) | 424.0 |

-continued

| | mg/ft$^2$ |
|---|---|
| Sensitizing dye | 0.6 |
| 4-Benzenesulfonamidophenol developer | 133.0 |
| 4-Methyl-2-pentanone solvent | 45.0 |
| SUPPORT - 4 mil blue poly(ethylene terephthalate) film | |

In the following example, only the composition of the photothermographic layer was varied. The composition of the remainder of the film was constant and as described above. Four identical sample films were prepared as above with the only differences being the presence of the intentional foggant $SnCl_2$ and the type/level of the antifoggant as specified in Table I.

TABLE I

| Coating ID | Amount $SnCl_2$ Foggant | Antifoggant, mg/ft$^2$ Type/Level |
|---|---|---|
| 1 | None | None (Control) |
| 2 | 0.12 mg/ft$^2$ | None |
| 3 | 0.12 mg/ft$^2$ | $HgBr_2$, 0.22 |
| 4 | 0.12 mg/ft$^2$ | Compound 2, 5.5 |

These four coatings were exposed on an EG&G sensitometer equipped with a xenon flash lamp having a $10^{-3}$ sec exposure time, through a step wedge. Immediately after the exposure step, the films were heat processed at 119° C. for five seconds. The negative images on each film were evaluated on a densitometer using Status A, blue filtration. The sensitometric data for each film is recorded in Table II. Image tone was subjectively evaluated.

TABLE II

| Coating ID | Dmin | Dmax | Speed | Image Tone |
|---|---|---|---|---|
| 1 | 0.10 | 3.07 | 306 | Brown |
| 2 | 1.60 | 3.01 | — | Brown |
| 3 | 0.11 | 3.18 | 290 | Brown |
| 4 | 0.22 | 3.20 | 301 | Black |

The sensitometric data in Table II demonstrates that the use of the sulfenimide antifoggant Compound 2 is effective is reducing the level of Dmin in an emulsion layer that had been intentionally fogged, without having a substantial bad impact on other sensitometric parameters. Also, that the image tone in the film containing the sulfenimide antifoggant was significantly more neutral than the control film. When the same films were similarly exposed as in Table II but heat processed at 125° C. rather than 119° C., the following sensitometric data were obtained:

TABLE III

| Coating ID | Dmin | Dmax |
|---|---|---|
| 1 | 0.48 | 3.07 |
| 2 | Dmax, fog, no image | |
| 3 | Dmax fog, no image | |
| 4 | 0.52 | 3.12 |

The sensitometric data in Table III demonstrates that the sulfenimide antifoggant Compound 2 is effective in suppressing thermal fog or process fog.

The coatings containing the sulfenimide antifoggant compound #2 exhibited good keeping sensitometry over extended time. Coatings 1–4 of the above series were stored at 15% relative humidity at room temperature for six months, then removed from this environment and exposed and processed at 119° C. as above. The sensitometric results are shown in Table IV.

TABLE IV

| Six Month Simulated Trade Pack Keeping | | |
|---|---|---|
| Coating ID | Dmin | Dmax |
| 1 | 0.12 | 2.50 |
| 2 | 0.17 | 2.23 |
| 3 | 0.12 | 2.37 |
| 4 | 0.13 | 2.65 |

Sulfenimide compounds having substituent groups in various positions other than those in Compound 2 are also useful as antifoggants as Dmin levels are significantly reduced using these materials. A variation on the structure of Compound 2 was tested: Compound 49. This compound also shows the desired antifogging and keeping effects.

TABLE V

| Coating ID | Amount $SnCl_2$ Foggant | Antifoggant, Type/Level |
|---|---|---|
| 1 | None | None (Control) |
| 2 | 0.12 mg/ft$^2$ | None |
| 3 | 0.12 mg/ft$^2$ | $HgBr_2$, 0.22 mg/ft$^2$ |
| 4 | 0.12 mg/ft$^2$ | Compound 49, 3 mg/ft$^2$ |
| 5 | 0.12 mg/ft$^2$ | Compound 49, 6 mg/ft$^2$ |

TABLE VI

| | FRESH | | | | 4 WEEK AGED | | |
|---|---|---|---|---|---|---|---|
| | 119° C. Processed | | 125° C. Processed | | 119° C. Processed | | |
| Coating ID | Dmin | Dmax | Dmin | Dmax | Dmin | Dmax | Speed |
| 1 | 0.16 | 3.10 | 0.29 | 3.22 | 0.13 | 3.23 | 315 |
| 2 | 1.92 | 3.06 | 1.93 | 3.27 | Dmax fog | — | — |
| 3 | 0.11 | 2.89 | 0.34 | 3.10 | 0.11 | 3.15 | 302 |
| 4 | 0.12 | 2.59 | 0.23 | 2.91 | 0.15 | 2.80 | 243 |
| 5 | 0.15 | 2.19 | 0.24 | 2.89 | 0.11 | 2.48 | 203 |

The invention has been described in detail, with particular reference to certain preferred embodiments thereof, but it should be understood that variations and modifications can be effected within the spirit and scope of the invention.

What is claimed is:

1. A thermally processable imaging element comprising a support and a thermographic or photothermographic imaging layer, said imaging layer comprising a sulfenimide compound represented by the formula:

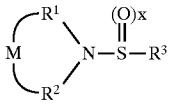

wherein M represents the atoms necessary to form, with $R^1$ and $R^2$, a five or six-membered ring or a multiple ring system; $R^1$ and $R^2$ are independently carbonyl or sulfonyl groups; $R^3$ is independently a substituted or unsubstituted aliphatic, aromatic or heterocyclic group and x is 0 or 1.

2. The imaging element of claim 1 wherein $R^3$ is independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

3. The imaging element of claim 1 wherein M represents the atoms necessary to form, with $R^1$ and $R^2$, a substituted or unsubstituted aryl group having 6 to 10 carbon atoms or a substituted or unsubstituted 5 to 10-membered heterocyclic ring.

4. The imaging element of claim 3 wherein $R^1$ and $R^2$ are carbonyl groups.

5. The imaging element of claim 4 wherein M represents the atoms necessary to form, with $R^1$ and $R^2$, a phthalimide or succinimide group.

6. The imaging element of claim 3 wherein $R^3$ is independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

7. A thermally processable imaging element, said element comprising:

(a) photographic silver halide, (b) an image-forming combination comprising (i) an organic silver salt oxidizing agent, with (ii) a reducing agent for the organic silver salt oxidizing agent, and (c) a sulfenimide compound represented by the formula:

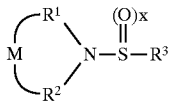

wherein M represents the atoms necessary to form, with $R^1$ and $R^2$, a five or six-membered ring or a multiple ring system; $R^1$ and $R^2$ are independently carbonyl or sulfonyl groups; $R^3$ is independently a substituted or unsubstituted aliphatic, aromatic or heterocyclic group and x is 0 or 1.

8. The imaging element of claim 7 wherein $R^3$ is independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

9. The imaging element of claim 7 wherein M represents the atoms necessary to form, with $R^1$ and $R^2$, a substituted or unsubstituted aryl group having 6 to 10 carbon atoms or a substituted or unsubstituted 5 to 10-membered heterocyclic ring.

10. The imaging element of claim 9 wherein $R^1$ and $R^2$ are carbonyl groups.

11. The imaging element of claim 10 wherein M represents the atoms necessary to form, with $R^1$ and $R^2$, a phthalimide or succinimide group.

12. The imaging element of claim 9 wherein $R^3$ is independently a substituted or unsubstituted alkyl group having 1 to 6 carbon atoms, a substituted or unsubstituted aryl group having 6 to 10 carbon atoms or a substituted or unsubstituted 5 to 6-membered heterocyclic ring.

13. The imaging element of claim 7 wherein the concentration of the sulfenimide compound is from 0.001 to 0.5000 mole per mole of silver salt oxidizing agent.

14. The imaging element of claim 13 wherein the concentration of the sulfenimide compound is from 0.001 to 0.05 mole per mole of silver salt oxidizing agent.

15. The imaging element of claim 7 wherein the organic silver salt oxidizing compound is silver behenate.

16. The imaging element of claim 15 wherein the reducing agent is a phenolic reducing agent.

* * * * *